United States Patent [19]

Villette

[11] 4,304,274

[45] Dec. 8, 1981

[54] VEHICLE TANK SECURITY DEVICE

[76] Inventor: Roger Villette, Route d'Arles, Crau-Sud, Salon, France, 13300

[21] Appl. No.: 88,560

[22] Filed: Oct. 26, 1979

[30] Foreign Application Priority Data

Oct. 27, 1978 [FR] France ..... 78 31262

[51] Int. Cl.[3] ..... B65B 3/04; B65B 57/00

[52] U.S. Cl. ..... 141/392; 137/38; 137/351; 180/271

[58] Field of Search ..... 137/38, 351; 141/388, 141/392, 98, 346; 180/271

[56] References Cited

U.S. PATENT DOCUMENTS 2,847,023 8/1958 Hansen et al. ..... 137/351

4,024,897 5/1977 Hall ..... 141/392

4,099,551 2/1978 Billington et al. ..... 141/388

*Primary Examiner*—Frederick R. Schmidt

*Attorney, Agent, or Firm*—Sandler & Greenblum

[57] ABSTRACT

A security device for vehicle tanks is provided which automatically assures the closing of tank valves when the tank is being filled or emptied and the vehicle is subjected to accidental displacement or other movement. The devie includes a vehicle displacement detector assembly comprising an oscillating arm which contacts either the ground or an element which moves the vehicle. Movement of this assembly, in turn, drives a transmission assembly, which is activated by the displacement of a roller driven by an oscillation shaft of the detector assembly. This transmission assembly is, in turn, connected to and controls a tank valve control.

4 Claims, 4 Drawing Figures

VEHICLE TANK SECURITY DEVICE

DESCRIPTION OF THE INVENTION

1. Field of the Invention

The object of the invention relates to a security device for the tanks of tankers.

It is adapted to automatically assure the closing of tank valves when in the course of tank filling or emptying operations, the vehicle is subjected to an accidental displacement.

2. Discussion of the Prior Art

In known devices of this type, a hoist has generally been used connected by an eye or lug to the wheel of the vehicle. A cable attached both to the hoist box and to the closing device of the valves assures the closing of the valves when the wheel undergoes a rotational movement. These devices are subject to deterioration and, despite the simplicity of their operation, have not been sufficiently reliable because of the ease with which they are neutralized.

SUMMARY OF THE INVENTION

The device according to the invention overcomes these disadvantages and allows for permanent installation on a vehicle, a simplified mode of operation, and for absolute reliability by virtue of the fact that the opening of the valve cannot open until the device has been put in service, and its operation is assured as soon as the vehicle is translationally moved in any direction.

The device comprises the combination of a vehicle displacement detector assembly comprising an oscillating arm with a telescopic shaft for contact with the ground or with an element serving to move the vehicle, the arm mounted on a bearing fixed on a stationary portion of the vehicle, such as a mainbeam, the device driving via an oscillation shaft a roller together with a transmission or receiver assembly activated by the displacement of the roller on a piston receiver, the assembly being connected to the control for opening and closing of the tank valve.

BRIEF DESCRIPTION OF THE DRAWINGS

In the annexed drawings given by way of non-limiting example, one of the embodiments forming the object of the invention is shown as follows.

DETAILED DESCRIPTION OF THE DRAWINGS

Figure 1:
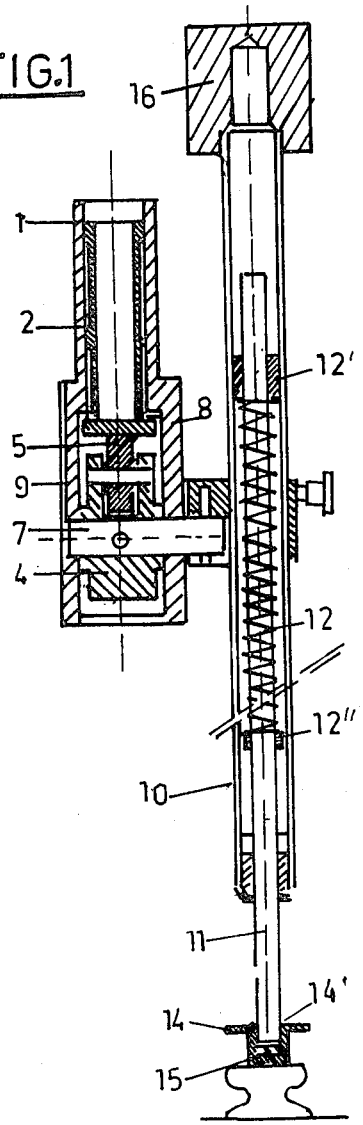
FIGS. 1 and 2 illustrate the detector device assembly as seen in elevation and in longitudinal and transverse cross-sectional views, respectively.
Figure 2:
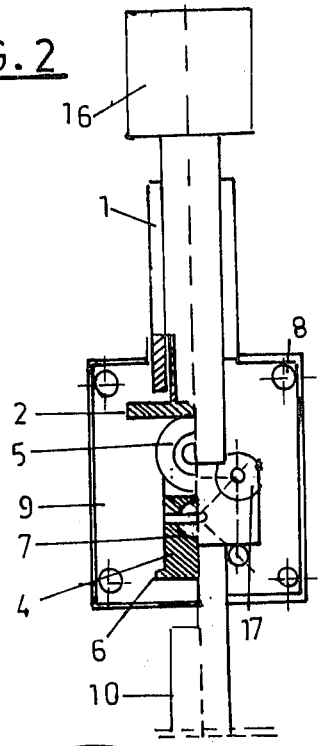

The apparatus is attached at a point exterior to a vehicle chassis at a stationary element which does not serve to displace the vehicle.

As shown in FIGS. 1–4, the apparatus comprises a casing or bored body 1 in which a tubulas piston 2 biased by a spring 3 slides. The casing is mounted on a fixed portion of the vehicle chassis. The piston is activated by a lever 4 on which a roller 5 is mounted. The lever also comprises symmetric shoulders 6. A wheel rotates on journalled shaft 7, carried by bearings 8 and 9.

Shaft 7 is connected at an external end to a pin means integral with tubular arm 10 in the axis of which slides a second telescopic shaft 11 biased by a spring 12, said spring having a point fixed on shoulder 12' and a moveable support point bearing on the shoulder 12''. This sliding shaft is maitained in extended position by spring 12.

The interior end of the shaft 11 is provided with a support base 14 to which is attached an elastic sole 14' in contact with the ground or with an element serving to move the vehicle.

This vehicle displacement detector assembly is in contact with the ground or with an element serving to move the vehicle, and is mounted on a journal forming a swivel joint, which can comprise, e.g. a magnet 15 in the case where the assembly is in contact with a rail or metallic surface.

The upper end of the assembly comprises a counterweight 16, which facilitates the biasing of the piston and its manipulation. Shaft 11 slides parallel to the receiver assembly in its stop position and perpendicular in its security position. The interior end of the shaft has a support base to which a flexible carrier or sole is mounted.

Shaft 11 and telescopic arm 10 are arranged perpendicularly to the support during the placement of the security device, and folded parallel to the support when the emptying or filling operations of the tank have been completed.

The valves cannot be opened unless the security device is in place.

Lock 17 (FIG. 3) automatically immobilizes the arm 10 in its rest position and prevents any movement of the arm during the movement or stopping of the vehicle.

A reinforcement beam 19 attached to the base of piston 2 connects the cable 18 extending through cover 20 which forms the fixed point of the spring 3.

The cable slides within casing 21 and opposite cable end 18' is connected to a stirrup 22. The casing is stabilized at each of its ends by one of the adjustable shoulders 23 and 24. The shoulders are fixed in the cover and in a support at an opposed end of the flexible casing.

This transmission is activated by the displacement of roller 5, driven by shaft 7, and arm 10 when the vehicle is accidentally moved. These elements together comprise part of a receiver assembly.

Figure 4:
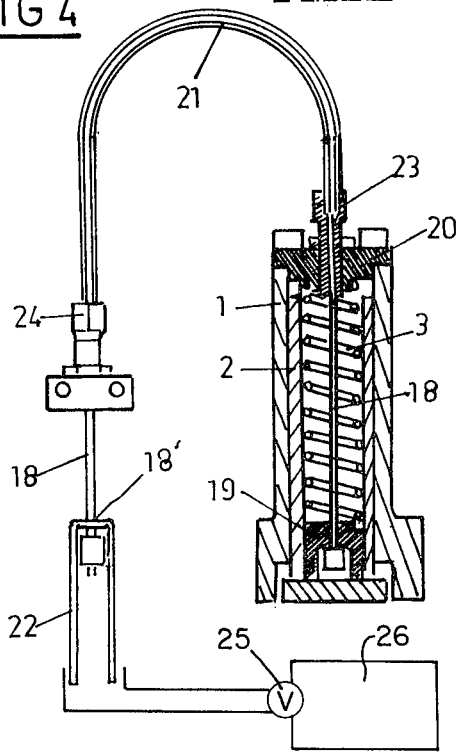
FIG. 4 is a cross-sectional view of the transmission device of the locking control.
Figure 3:
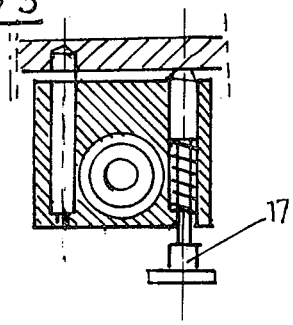
FIG. 3 illustrates the constructional details on an enlarged scale, of the locking control for the detection arm.

The arc described by the roller displaces piston 2 in the vertical plane. This displacement transmits movement via the cable 18, to stirrup 22, which assures automatic closing of the valve by connection to the locking device which activates both the valve closing and opening. Movement of the stirrup can either directly or indirectly cause the closing of valve 25, which is associated with tank 26 as best illustrated in FIG. 4.

When the arm 10 is lifted, the lock of the valve is maintained closed, and cannot open except when shaft 11 perpendicularly contacts either the ground or an element serving to move the vehicle.

Beginning with the movement impressed by the roller 5 on a receiving element, the transmission can be a hydraulic, magnetic, pneumatic, electromagnetic, or mechanical assembly.

The device is characterized by the movement impressed upon the arm which contacts either the ground or an element serving to move the vehicle by the displacement of the vehicle, the displacement of the arm being, into a position perpendicular to its support point.

The movement transmitted to the receiver element by the movement of the roller over an arc makes it possible to utilize the movement of the piston, which has a path of several centimeters, to activate the locking of the valve.

Although one specific form of the apparatus is disclosed, the shapes, dimensions and arrangements of different elements may vary within the limits of equivalents as well as materials utilized in manufacture, without changing the general conception of the invention which has just been described.

Alternatively the arm can be placed in contact with a wheel by application to a peripheral point so as to allow for reduced interference and greater simplicity of manipulation. In such a case the counterweight and the lock can be eliminated.

What is claimed is:

1. A security device for vehicle tanks, said device being adapted to automatically assure the closing of tank valves when a vehicle undergoes displacement during emptying or filling of said tanks, said device comprising a safety lock which prevents opening or closing of a valve unless said lock is placed in a predetermined position, a vehicle displacement detector assembly connected to said lock and having an oscillating tubular arm adapted to be placed in perpendicular contact with either the ground or with an element serving to move said vehicle, and a receiver assembly for activating a control to open and close said valve, said receiver assembly comprising a casing mounted on a fixed portion of a vehicle chassis, a tubular piston slideably biased within said casing by a spring, said piston adapted to be activated by a lever on which a roller is mounted and to be contacted by said roller moving in response to movement of said oscillating arm, a beam integral with said piston, said beam retaining one end of a cable maintained under tension by said spring, said cable extending through a rigid cover at one end of said casing and adapted to slide over the length of a flexible second casing, a second end of said cable being connected to a stirrup which controls said tank valve, said lever including two symmetric shoulders and adapted to be rotatably driven in a plurality of directions by a journalled shaft on which it is positioned, said journalled shaft having an external end connected to said tubular arm, a telescopic shaft adapted to slide within said tubular arm, said telescopic shaft being maintained in an extended condition by a return spring and adapted to slide within said tubular arm parallel to said receiver assembly when in a stop position and perpendicular to said receiver assembly when in a security position, said telescopic shaft including a support base and a flexible mounting carrier for attachment and cushioning which are positioned at an end of said telescopic shaft which is adapted to be adjacent to the ground or said element.

2. A security device in accordance with claim 1 wherein said base comprises a magnet and said carrier comprises an elastic sole.

3. A security device in accordance with claim 1 wherein said telescopic shaft has an upper end comprising a counterweight.

4. A security device in accordance with claim 1 wherein the flexible casing within which said cable slides has an adjustable shoulder at each of its ends, one of said shoulders being fixed in said rigid cover and the other of said shoulders being fixed in a support mounted at the opposite end of said flexible casing.

* * * * *

UNITED STATES PATENT AND TRADEMARK OFFICE

CERTIFICATE OF CORRECTION

PATENT NO. : 4,304,274

DATED : December 8, 1981

INVENTOR(S) : Roger VILLETTE

It is certified that error appears in the above—identified patent and that said Letters Patent is hereby corrected as shown below:

In the Abstract, line 5, "devie" should be changed to --device--.

In the Specification, Column 1, line 64, "tubulas" should be changed to --tubular--;

Column 2, line 7, "the" should be changed to --return--;

Column 2, line 52, "the" should be deleted.

Signed and Sealed this

*Twenty-third* Day of *March 1982*

[SEAL]

*Attest:*

GERALD J. MOSSINGHOFF

*Attesting Officer*

*Commissioner of Patents and Trademarks*